United States Patent [19]

Reece

[11] 3,989,017

[45] Nov. 2, 1976

[54] INTERNAL COMBUSTION ENGINE FUEL CHARGE TREATMENT

[76] Inventor: Oscar G. Reece, 3609 NE. 10th, Amarillo, Tex. 79601

[22] Filed: July 15, 1974

[21] Appl. No.: 488,485

[52] U.S. Cl. ..... 123/119 E; 123/119 B; 123/122 A; 123/122 F

[51] Int. Cl.[2] ..... F02M 27/04

[58] Field of Search..... 123/119 E, 122 A, 122 F, 123/119 B, 127, 1 R, 198 R

[56] References Cited

UNITED STATES PATENTS

| | | | |
|---|---|---|---|
| 1,361,503 | 12/1920 | Smith | 123/122 F |
| 2,311,828 | 2/1943 | Hansen et. al. | 123/127 |
| 2,851,027 | 9/1958 | Kiveld | 123/122 F |
| 3,088,447 | 5/1963 | Henderson | 123/119 B |
| 3,116,726 | 1/1964 | Kwarz | 123/119 E |
| 3,144,011 | 8/1964 | Anthes | 123/119 B |
| 3,177,633 | 4/1965 | McDonald, Jr. | 123/119 E |
| 3,215,417 | 11/1965 | Whitmore et al. | 123/122 F |
| 3,266,783 | 8/1966 | Knight | 123/119 E |
| 3,349,354 | 10/1967 | Miyata | 123/119 E |
| 3,406,669 | 10/1968 | Edwards | 123/119 B |
| 3,664,368 | 5/1972 | Sweeny | 123/119 B |

FOREIGN PATENTS OR APPLICATIONS

| | | | |
|---|---|---|---|
| 714,015 | 8/1954 | United Kingdom | 123/119 E |

OTHER PUBLICATIONS

1973 Car Shop Manual vol. 2 "Engine" Ford Marketing Corp. 9/72, pp. 21–24–02.

*Primary Examiner*—Wendell E. Burns
*Assistant Examiner*—David D. Reynolds
*Attorney, Agent, or Firm*—Ely Silverman

[57] ABSTRACT

Electromagnetic treatment of liquid fuel charge shortly prior to atomization in carburetor and of cycled crankcase gaseous suspension prior to passage to automobile internal combustion engine combustion chamber improves fuel utilization efficiency and reduces pollutants in exhaust.

14 Claims, 15 Drawing Figures

INTERNAL COMBUSTION ENGINE FUEL CHARGE TREATMENT

BACKGROUND OF THE INVENTION

1. The Field of the Invention

The field of art to which this invention pertains is charge forming devices for internal combustion engines.

2. Description of the Prior Art

The prior art of fuel charge treatment for internal combustion engines teaches heating the entire gas-fuel mixture, e.g. U.S. Pat. Nos. 3,640,254, 3,625,190 and 3,472,214. Such apparatuses reduce the weight of combustible matter contained within the cylinder in which combustion occurs or interfere with the free flow of the fuel-air mixture to the zone of combustion. This problem of incomplete combustion with consequent reduced mileage per gallon of gasoline fuel with production of pollutants including products of incomplete combustion has been long outstanding.

SUMMARY OF THE INVENTION

The magnetic characteristics of the metal engine block developed by the electrical ignition circuit of the internal combustion engine are utilized by impressing on the liquid gasoline fuel a magnetic characteristic while compensating for the clumping otherwise later produced by a concurrent heating. The gasoline droplets and the particles returned through the pollution control valve system are thereby selectively directed into contact with the hot metal walls of the combustion cylinders. The theretofore atomized particles of fuel are vaporized and efficiency of combustion of the fuel thereby improved, and high combustion temperature achieved with reduction of incomplete combustion products in the exhaust.

DESCRIPTION OF THE PREFERRED EMBODIMENT

Figures 1, 2:
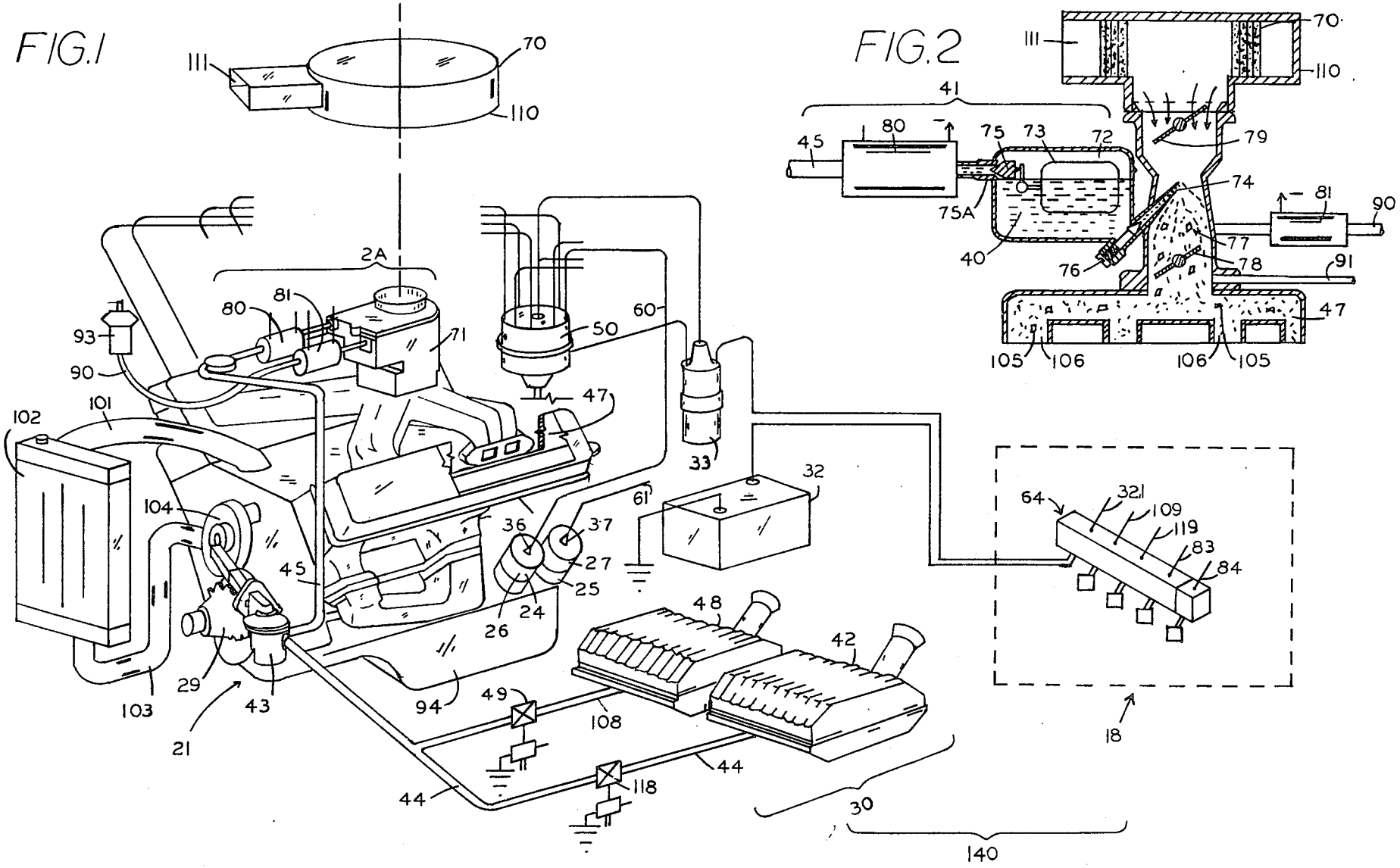
FIG. 1 is an expanded diagrammatic view of parts of the system of this invention to illustrate their relation to each other during operation, as seen from left (driver's side) front, and broken away in part.
FIG. 2 is an enlarged diagrammatic view of the zone 2A of FIG. 1 in a vertical longitudinal section.

In a preferred embodiment of an apparatus, 20, according to this invention, process features are also demonstrated.

Apparatus 20 comprises an engine 30 and, in cooperative combination therewith, feed treatment coils 80 and 81 that are incorporated in the fuel system, electrical system and mechanical system of the engine 30. Engine 30 is, in the particular embodiment shown, a water cooled reciprocating piston internal combustion gasoline-fueled engine, although the instant invention is also applicable, as below described to air cooled and rotary internal combustion engines. The apparatus 20 thus comprises, in cooperative combination, a mechanical system 21, an electrical system 31, and a fuel system 41 in a car 140.

The car 140 is a gasoline powered automobile comprising, in operative combination, a conventional steering gear and frame 19, a passenger cab 18 and engine apparatus 20 with the cab 18 containing a steering wheel and an instrument panel 64 with ignition switch 32.1 and other switches peculiar to the engine 30 on such instrument panel. Engine 30 is mounted in the engine compartment 17 of the car 140 in conventional manner (as described, for instance, in Elliott and Consoliver, *The Gasoline Automobile*, McGraw-Hill, 1939).

The systems 21, 31 and 41 are organized and connected as in usual internal combustion engine (as described in *Encyclopedia Britannica*, Edition of 1969, Volume 12, pages 388–403 and Elliott and Consoliver *The Gasoline Automobile*, McGraw-Hill, 1939) but with the additional structure and functions provided by the coils 80 and 81.

The mechanical system comprises a conventional cast iron or steel engine block 22 wherein several pistons as 24 and 25 are located in conventional manner within cylindrical spaces therefor as 26 and 27, respectively; each of the pistons is connected to a crank shaft 28 rotatably located in block 22 and which (28) drives a timing gear 29 which is operatively connected to a distributor shaft 52 of the electrical system 31 in conventional manner; range of r.p.m. is 2,000 to 4,000 r.p.m. The car 140 is a Chrysler station wagon, 383 cubic inch engine, 1968 Model, vehicle identification NO. CE46H8C118491

The electrical system 31 comprises, in operative combination, a 12-volt battery 32, a conventional ignition coil 33 with primary windings 34 and secondary windings 35 and distributor 50 and coils 80 and 81. The conventional distributor 50 includes an adjustably mounted distributor rotor 51 and a fixedly mounted distributor cam 53 on a rotatably mounted shaft 52. The distributor cam contacts the breaker arm 55 which breaker arm 55 carries one movable contact point 58 while another contact point 59 is fixedly and directly connected to ground 67. The rotor cap 54 is made of electrically insulating material and carries a plurality of metal inserts as 56 and 57 — one for each cylinder —; spark plug cables as 60–61 connect each of the metal inserts to the center terminal of each of the corresponding spark plugs as 36 and 37 for each of the cylinders as 26 and 27. Each spark plug as 36 has a center terminal 63 and is threaded for contact with the block and includes firmly attached thereto a ground terminal 65 which thus connects to the ground or body of the vehicle as 67. The ground electrode or terminal 65 projects into the space of the cylinder while the center electrode 63 is located on the central longitudinal axis of the spark plug and a spark gap 62 is provided between the ground electrode and the center negative electrode.

The electrical battery also supplies voltage across the fuel magnetization coil 80 and pollution control valve line magnetization coil 81.

The fuel system 41 comprises, in conventional operative connection, a gasoline tank 42 operatively connected to fuel pump 43 via line 44. Pump 43 drives liquid fuel 40 through an inlet line 45 and pressure regulator 97 to a conventional carburetor 71 which comprises a float chamber 72, Wherein is located a float, 73, and an outlet nozzle 74. The float 73 is pivotally supported on the walls of the chamber 72 and moves a chamber inlet valve plug 75 in and out of blocking relationship to the carburetor inlet valve orifice seat 75A. A nozzle 74 has a conventional control screw 76 and provides, in conventional manner, for control of the volume of liquid fuel transmitted into the throat 77 of the carburetor 71 while the throttle 78 and the choke 79 assist in conventional manner in forming the air flow.

The carburetor 71 is conventional and is described herein only briefly and may include varied acceleration systems and added nozzles, pilot systems for cold starting, and up draught and cross draft carburetors may be used rather than the down draft carburetor shown in FIGS. 1 and 2; such conventional modifications are shown in "The Way Things Work", Volume 1, pages 478–481, Simon and Schuster, New York, 1967. Such carburetors are made of a non-magnetic low melting metal such as aluminum or zinc or alloys thereof. The lines 45 and 90 are made of a non-magnetic metal or alloy, as copper or aluminum, as is conventional for such components. Additionally, a second source of fuel, as diesel fuel, in tank 48 is connected through a cut-off valve 49 to line 45.

A conventional air cleaner 70 is located on top of inlet of throat of carburetor 71 and has a large outer diameter 110 than the carburetor inlet opening or body and air inlet 111.

Coil 80 is a double layered helical coil with the central longitudinal axis of each of its component coils 87 and 88 coaxial with each other and coaxial with the central longitudinal axis of the portion of the gas line 45 immediately adjacent to the carburetor inlet valve seat.

Coil 81 is a double layered helical coil with the central longitudinal axis of each of its component coils 85 and 86 coaxial with each other and coaxial with the central longitudinal axis of the portion of the return line 96 adjacent carburetor 71.

One, negative, end of coil 81 is operatively connected to the negative pole of the battery 32 through a switch 83 and one, negative end, of coil 80 is operatively connected to the negative pole of battery 32 through a switch 84; the electrically positive ends of the coils 80 and 81 are connected to the ground. Switches 83 and 84 are located in the cab or passenger compartment of the vehicle in which cab 18 the ignition switch 32.1 and the throttle control for the engine 30 are located.

Figure 7:
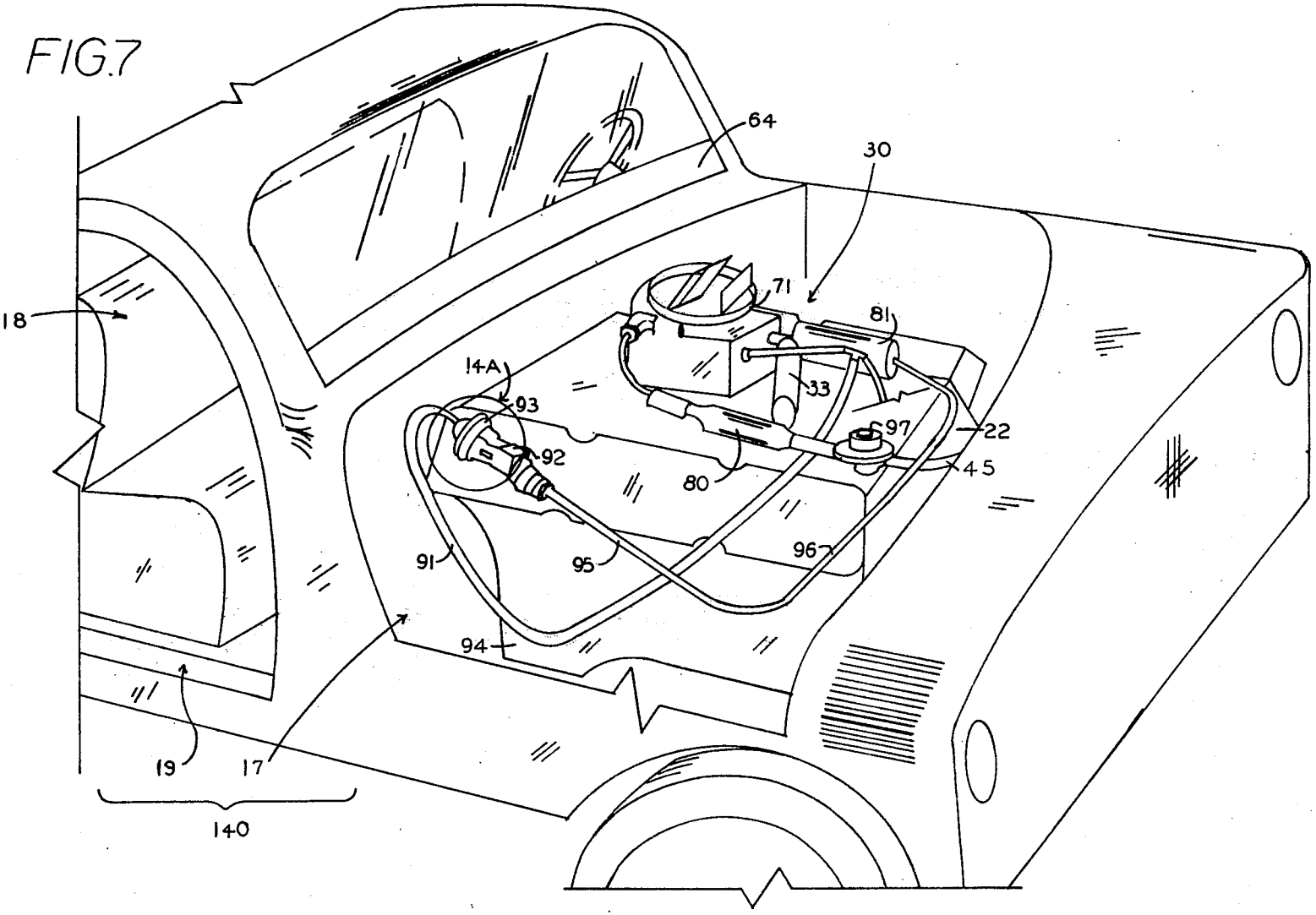
FIG. 7 is a diagrammatic oblique pictorial view of the apparatus 20 as seen from above and its right side in a car 140.

The crankshaft rotates in a standard crankcase space 23 defined by an oil pan 94 held to the bottom of the block 22. A crankcase outlet 92 is connected by a pollution control valve vacuum controlled valve 93 to a pollution control valve conduit line 90. Conduit line 90 comprises, in series, a rubber tubing 95 and a copper tube 96 operatively connected to the throat 77 of carburetor 71. The coil 81 is located with its central longitudinal axis coaxial with the portion of pollution control valve return line 90 immediately adjacent to carburetor 71 and, as shown in FIG. 7, with its central longitudinal axis parallel to axis of coil 80. A regulator valve as 97 may also be located in line 90 between valve 93 and coil 81.

Figure 3:
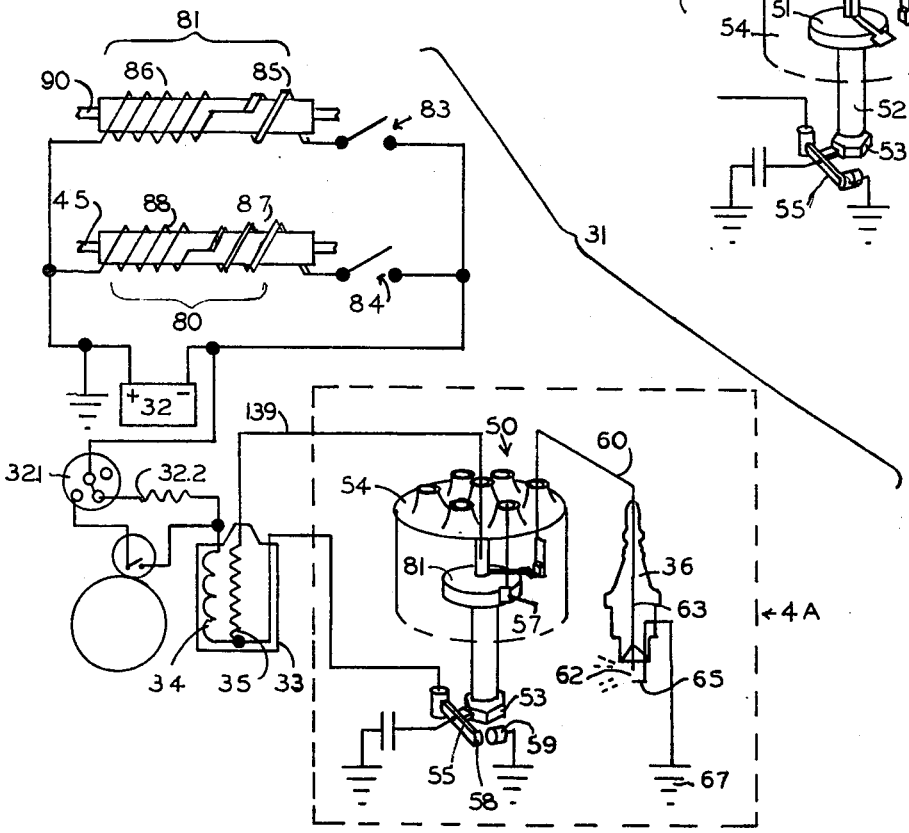
FIG. 3 is a wiring diagram and diagrammatic showing of relations of the ignition and coil components of the electrical system of the apparatus of this invention when contact points are open.
Figure 4:
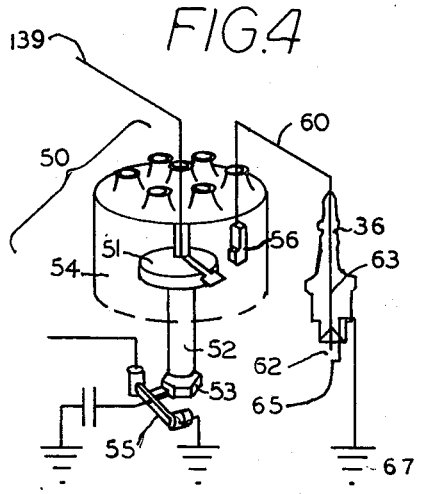
FIG. 4 illustrates the position of distributor parts in zone 4A of FIG. 3 at times when the contact points are closed.
Figure 6:
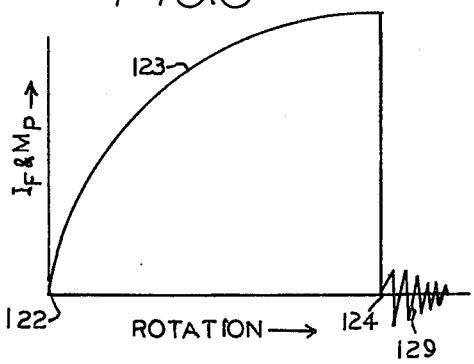
FIG. 6 diagrammatically shows the build-up of magnetic field in the primary coil with time.

In the conventional apparatus of motor 20, the ignition coil 33 is located, as shown in FIG. 7, adjacent the body of the car and fixedly located in a position such as under the air cleaner 70 so that the terminals of such coil are in a substantially splash-proof position — i.e., protected from splash upward from ground and from above. In such position, the magnetic field produced by the coil below described is detectable by a hand held pocket field compass (as in Edmunds Catalogue No. 741, page 99, item no. 30235). While the engine is running, current flow in the primary ignition circuit with the ignition circuit components in run position, is as shown in FIGS. 3 and 4, i.e., electric current flows through the primary circuit (comprising the battery 32, the ignition switch 32.1, the resistor wire 32.2, the primary winding 34, the closed ignition contact points 58 and 59) and then to the ground 67, while magnetic lines of force are built up in the ignition primary coil 34 as shown in FIG. 6, during the time of dwell, which is the period of time during which points 58 and 59 are closed (as in FIG. 4). That magnetic field builds up in the primary of the coil in a major portion of time of each of the ignition cycle steps, and, because of its propinquity to the block and frequency (about 12,000 sparks per mile, or 200 sparks per second in a vehicle traveling 60 miles per hour) that magnetic field is, in the overall effect, unidirectional and causes a substantially constant magnetic field to be established through the block 22, which field is detected by a compass held adjacent to the block, and is directed toward the carburetor thereof from both front and rear ends in 140.

Figure 5:
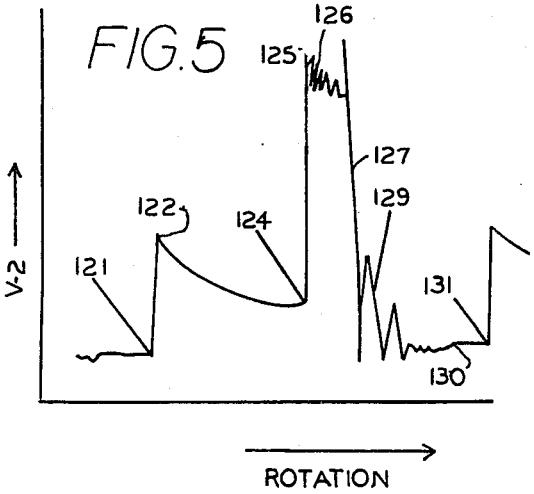
FIG. 5 is a graphical showing of the voltage induced across the terminals of the secondary coil as measured by an oscilloscope.

FIG. 3 illustrates the pathway for current flow in the ignition circuit while the engine is running immediately after the distributor cam opens the contact points 58 and 59 and interrupts the flow of current in the primary circuit. At such opening, the magnetic lines of force in the primary coil break down and induce a surge of high voltage current in the secondary coil winding 35. This high voltage surge travels to the distributor and through the rotor and spark plug cable to the spark plug and, at the spark plug, the high voltage current produces a spark by jumping the gap to the electrode. Generally, one cycle from the point opening to the point closing takes about 1/100th of a second at a normal 6 cylinder car traveling at 30 miles per hour and as shown in FIG. 5, is a minor portion of the total time of each cycle of ignition system and involves a much lower current than passes through the primary circuit (from 1/20% to about 1% thereof) as well as lasting a much shorter time (about 20% depending on motor speed) as shown in FIG. 5.

There is usually only a negligible delay (of about 25 millionths of a second) from the instant the points open 124 until the instant the plug fires 125; the center electrode of the spark plug is always negative inasmuch as the ground is positive in the preferred embodiment 30. Referring now to FIG. 5, an explanation of that pattern image where V-2 indicates the voltage across the terminals of the secondary coil and "rotation" indicates the degree of rotation of shaft 52 of distributor 50:

a. At 121 the distributor contact points close to begin the dwell period and are closed at 122;

b. Current flows through the primary circuit and begins building up a magnetic field within the coil at 122;

c. Line starting at 122 and ending at 124 represents the voltage during the following period with the contacts closed on dwell period;

d. At 124 contact points open and magnetic field around coil windings collapses, causing a high voltage in the secondary circuit, shown as 125;

e. At 125 high voltage jumps across spark plug gap to produce spark;

f. 126 represents discharge of high voltage across distributor and spark plug air gap;

g. At 127 spark ceases because of insufficient energy in coil to maintain spark;

h. At 129 wavy line represents dissipation of remaining energy in primary and secondary circuit; and i. From the end of oscillations 130 to point where contact points close 131 represents dissipation of energy remaining in primary circuit;

j. At 131 contact points close and cycle starts over again.

In each of these cycles of production of ignition sparks the magnetic field of the primary coil is developed over a longer period of time than the lower amperage discharge.

The change in strength of electric current in primary coil and the magnetic field developed across that primary coil 34 (shown as $I_f$ and $M_p$ in FIG. 6) during the above described cycle of operation in the secondary coil is diagrammatically illustrated by line 123 in FIG. 6. FIG. 6 is not to scale but is drawn with same referent numbers for same electrical events described for FIG. 5.

The coils 80 and 81 are actuated by connecting the coils 80 and 81 to the battery 32, preferably after the engine has reached its usual operating temperature.

As diagrammatically shown in the FIG. 2, a carburetor is substantially a siphon with a lesser pressure at the discharge 94 of the nozzle in the throat 77 whereby the liquid flows into the throat of the carburetor 71. Vaporization of such atomized particles heretofore depended upon for the transfer of heat from the body of the engine block warmed by exhaust gases to these small particles of liquid; the radiation from a body only at about 300° F., as are most engine bodies, is of limited effectiveness, and turbulent flow does not provide for complete vaporization. Such prior inefficiency and lack of vaporization are overcome by the use of coils 80 and 81 formed and connected as herein described.

The coils 80 and 81 each serve to provide and apply a magnetic field to the engine block 22 but primarily to provide a forceful magnetic fields to the fuel passing through line 45 and also to the particles passed through line 90 and thereby serve to improve vaporization and combustion efficiency and to destroy atmospheric pollutants.

Figure 8:
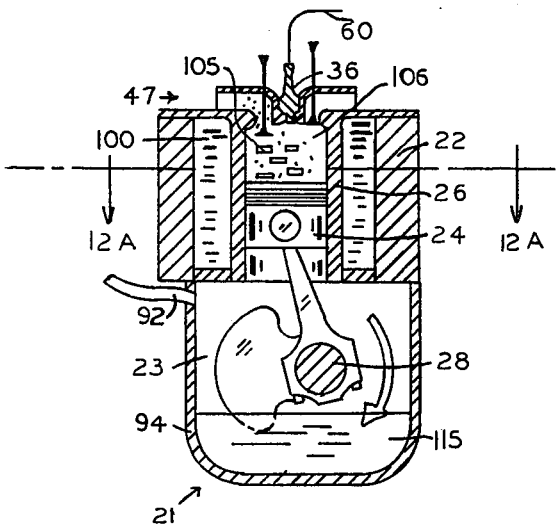
FIGS. 8 through 11 are diagrammatic successive views of the relations of the fluid mixture in one internal combustion engine cylinder of a system according to this invention during one cycle of steps of intake (FIG. 8), compression (FIG. 9), power (FIG. 10) and exhaust (FIG. 11).

As illustrated in FIGS. 8–12, there is substantially no magnetic field within each of the cylinder spaces as 26 when empty although readily detected magnetic forces (and, therefore, magnetic flux lines) are present through the surrounding portion as 66, of the cylinder block. Accordingly, the magnetized atomized fuel particles as 105 initially formed in the carburetor and swirled about in inlet manifold 47 and each combustion chamber as shown in FIG. 8 are magnetically drawn or forced into contact with the walls of each cylinder; such walls are, after the engine is "warmed up" at a usual temperature of 150° to 350° F.

Figure 10:
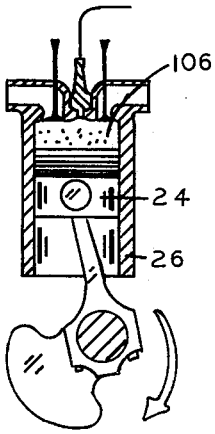
Figure 9:
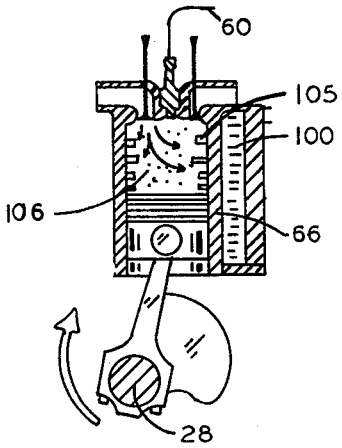
Figure 11:
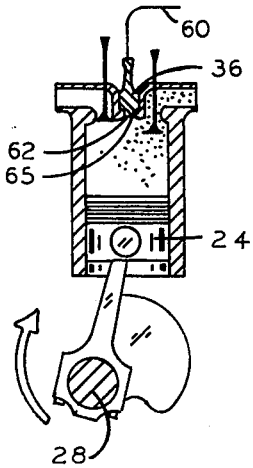
Figure 12:
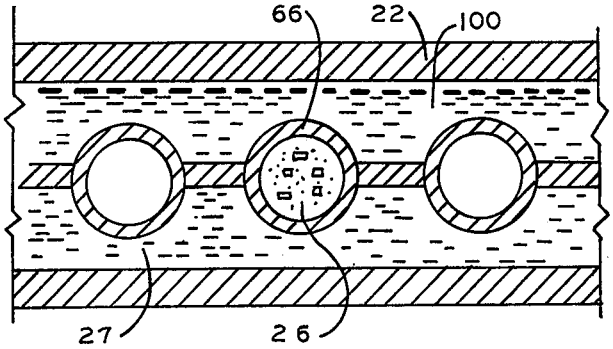
FIG. 12 is a transverse cross section through section 12A of FIG. 8 to illustrate magnetic field relations in the block 22 adjacent each cylinder space as 26.

In the interior of each cylinder, the droplets 105 formed in the carburetor throat and magnetically drawn into direct contact with hot warm magnetized cylinder walls, as diagrammatically shown in FIG. 9, are there vaporized; thereby no liquid droplets remain in the cylinder and all portions of the entire mass of fuel which had been theretofore atomized but not vaporized at the carburetor are completely vaporized in the cylinder prior to combustion, as diagrammatically shown in FIG. 10. For illustration of such action, the large droplets are shown as relatively large bars 105 and the zones of gaseous components are shown by dots 106 in FIGS. 8, 9, 10 and 11.

The forced and direct contact of magnetically charged liquid particles (or droplets) of gasoline with the magnetically charged walls of the engine cylinders provides for complete thermal transfer and full vaporization. The larger atomized particles have larger magnetic moments than the smaller particles and are selectively first drawn to the cylinder walls. This action of drawing atomized fuel portions to the cylinder walls results in a transfer of the heat of vaporization of the droplets from each wall of the combustion chamber and the top of the piston therein and thereby cools those surfaces and any lubricant thereon as well as vaporizing the gasoline droplets; also, by providing a transformation of the particles of gasoline into gas form, there is a more complete combustion of the fuel components and a higher combustion temperature whereby a lesser content of incomplete combustion product is produced than at usual combustion temperatures, and pollutants in the exhaust from such combustion apparatus are reduced. The improved combustion of the gasoline also provides for a more efficient use of the energy in the gasoline, thereby the engine runs cooler.

In operation of the apparatus 20, the particles carried along the line 90 to the zone of coil 81 are subjected to an intense magnetic field whereby those particles are also drawn to the warm cylinder surfaces and vaporized and thereby the contents of such droplets more effectively exposed to the high temperature gases in the cylinder and react with such high temperature gases produced by combustion in each of the engine cylinders as 25 and 26; also, the magnetization of the mixture in the pollution control valve return line 90 provides improvement in the overall combustion system of apparatus 20, because the gas-liquid mixture passing through line 90 contains a large portion of relatively non-volatile although small droplets from the crankcase (wherein much splashing occurs because of action of crankshaft 28 on the oil 115 in the crankcase) which are susceptible to magnetization by coil 81 and serve as nuclei for attachment thereto of very small atomized fuel particles that might not otherwise be drawn to cylinder walls for vaporization and complete combustion, and provide for their vaporization also.

The improved vaporization provided by this process permits that less volatile fuel than gasoline, as mixtures of gasoline and diesel fuel, may be fed to the carburetor of an engine as 30 (i.e., to a conventional engine as 20 fitted with the coils 80 and 81) after such engine has reached operating temperature; for such purpose, a separate tank 48 is connected by a line 108 to line 45 through valve 49. A switch 109 in the cab of the car 140 including the engine 20 controls the valve 49. Another switch 119 operates a control switch 118 in line 44 to open and close flow in line 44.

While the magnetic field strength of coils 80 and 81 are kept below any value that would cause binding of the moving parts of engine 30, the magnetic field developed by the passage of current through each of coils 80 and 81 is, as measured at its exterior surface, about four times as great as the magnetic field developed at the exterior surface of the ignition coil during its operation (as detected by the above described lensatic compass). The heating effect of the heating coil portion, as 87 of coil 80, is only sufficient to bring the temperature of each such entire coil to 150–200° F. when ambient air temperature is 80° F and is primarily directed to overcoming any clumping tendency of the magnetized fuel particles. Coil 81 is maintained at the 250°–300° C. by its heating component 85.

Each of the cylinders is cooled by a water jacket, as 100, with the jackets of all cylinders connected to a cooling water manifold and therethrough to an upper hose line 101 thence to top of radiator 102. A radiator discharge line 103 connects to a water pump 104 driven by crankshaft 28 and pump 104 is connected to and discharges into the cooling water manifold space. The rate of circulation of the liquid is, at operating temperature of the engine, directly proportional to the speed of the engine 30 (with any thermostat or temperature control valve between block 22 and radiator 102 open, as it is after the engine is "warmed up") in general.

Figure 13:
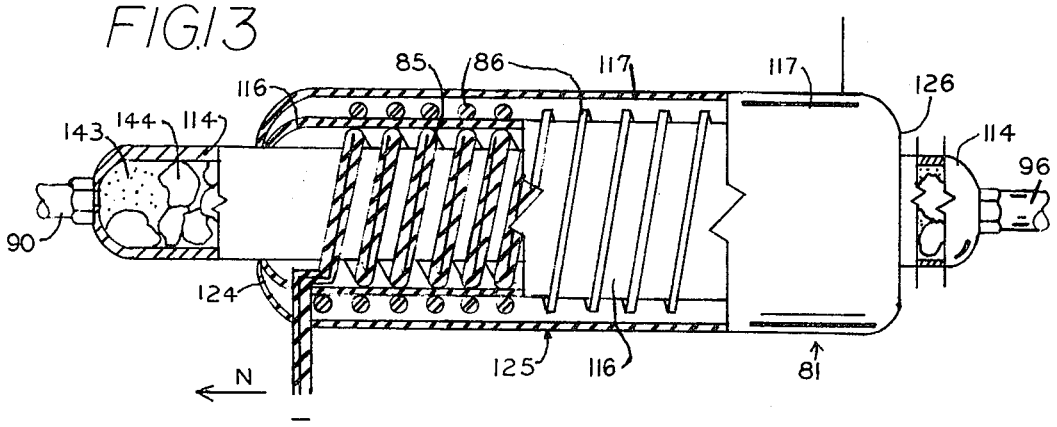
FIG. 13 is a diagrammatic broken away and sectional illustration of coil 81 structure.

The orientation of the coils provides for a supplementation of the magnetic field created by the primary transformer coil in the spark coil. As hereinabove explained, the engine operates at a cooler temperature with the coils 80 and 81 operative than it does with such coils shut off; also presence of noxious fumes such as nitrogen dioxide is reduced and the presence of incompletely combusted hydrocarbons is reduced. While the above explanation is given for the particular embodiment herein given, it is to be understood that the process of operation is not limited to the particular dimensions of apparatus and coil electrical and physical characteristics hereinabove given. The pollution control valve line (or crankcase ventilation) coil 81 comprises a helical heater coil 85 in series with a helical magnetization coil 86. The heater coil is formed of 40 inches of insulated No. 22 B and S CHROMEL wire, as a heating element 85, arrayed in 10 equally spaced parallel helical turns arranged in clockwise direction around a 1.05 inch i.d., 0.13 thick wall steel tube 114: as viewed from right side (as shown in FIGS. 13 and 7) while extending from left to right end of coil 80, as shown in FIG. 13. The insulated heater wire is close to but not in direct contact with the tube 114 and is surrounded by an inner insulating sleeve 116 made of asbestos cloth.

The magnetization coil 86 is composed of 10 feet of 22 gauge copper magnet wire in form of 25 turns of equally spaced parallel helical turns around the sleeve 116 and is surrounded by an outer cylindrical electrically insulating asbestos cloth sleeve 117. The turns are arranged in clockwise direction, as viewed from right side, as shown in FIG. 13, while extending from left to right end of coil 80, as shown in FIG. 13.

The current to the pollution control line coil 81 is three amperes and the current to the fuel coil 80 is 1½ amperes. The heating element determines the amperage and thereby the magnetic field: the circuit may be varied so that the fuel line coil draws 2 to 2¼ amperes. The length of the coil 81 from one left end 124 to the other end 126 is 4 inches and the diameter across its center portion 125 is 2 inches. Coil 81 is located, as shown in FIG. 2, near to the carburetor connection of line 45 and contains zinc nuggets 144.

The tube 114 is made of steel and acts to strengthen the magnetic field developed by coil 81 on the gaseous suspension 143 in tube 114 passing from line 90 to carburetor 71. The carburetor body 72.1 surrounding chamber 72 and float are usually made of non-magnetic materials such as copper, zinc and/or aluminum. The left hand coil end, 124 in FIG. 13 (front in FIG. 1), is connected to the positive terminal of the battery and the right hand end in FIG. 13 (rear end in FIG. 1) is connected to the switch 83 and switch 83 is connected to the negative terminal and switch 83 is located in panel 64 in cab 18 of car 140.

Figure 15:
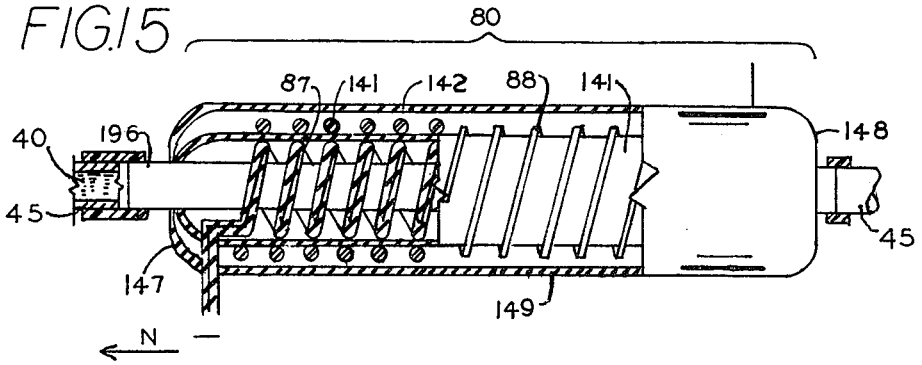
FIG. 15 is a diagrammatic broken away and sectional illustration of coil 80 structure.

The fuel line magnetization coil 80 comprises a helical heater coil 87 in series with a helical magnetization coil 88. The heater coil is formed of 40 inches of insulated No. 24 B and S CHROMEL wire, as a heating element 87, arrayed in 30 equally spaced parallel helical turns around a ¼ inch i.d., 0.4 o.d. steel tube 196: the turns are arranged in clockwise direction as viewed from right side (as shown in FIGS. 15 and 7) while extending from left to right end of coil 80, as shown in FIG. 15 (CHROMEL is a nickel-chromium alloy with nickel predominant and iron optional commonly used for heating elements).

The heater wire is close to but not in direct contact with the tube 196 and is surrounded by an inner insulating sleeve 141 made of asbestos cloth. The magnetization coil 88 is composed of 7 feet of 22 gauge copper magnet wire (as is used for electromagnets) in form of turns of equally spaced parallel helical turns around the sleeve 141 and is surrounded by an outer cylindrical electrically insulating asbestos cloth sleeve 142. The turns are arranged in clockwise direction, as viewed from right side, as shown in FIG. 15, while extending from left to right end of coil 80, as shown in FIG. 15.

The length of the coil 80 from one left end 147 to the other end 148 is 4 inches and the diameter across its center portion 149 is 1 inch. Coil 81 is located, as shown in FIGS. 1, 2 and 7, near to the carburetor connection of line 90.

The valve 93 comprises a rigid hollow valve body 137 which firmly supports a vacuum chamber 131 to which one end of a rigid cylindrical vacuum conduit line 91 is (see FIGS. 7 and 14) attached; the other end of that conduit line 91 is (see FIGS. 2 and 7) operatively attached to the throat of the carburetor 71. Thereby a relative vacuum in the carburetor throat 77 and manifold 47 (as occurs when engine 30 is running) is connected to the chamber 131 of valve 93. The interior of valve body 137 forms a chamber 138 that is in communication at one end (left in FIG. 14) with outlet 92 of crankcase space 23 and, at other end (right in FIG. 14) with a conduit 90 that connects to carburetor throat 77.

Figure 14:
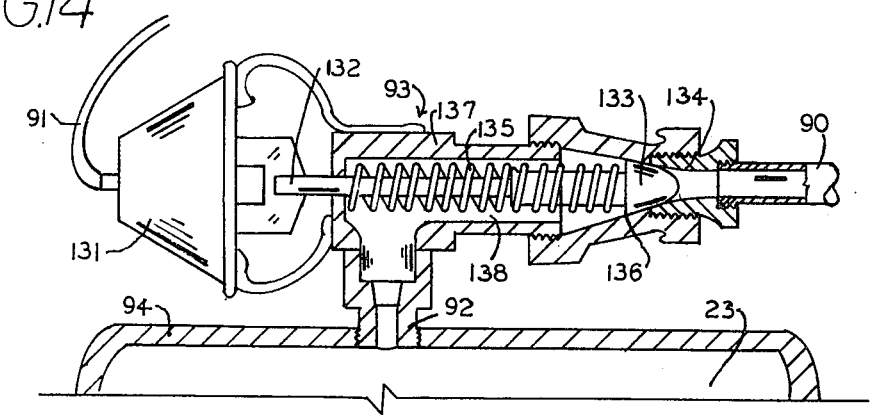
FIG. 14 is a diagrammatic sectional view of the vacuum controlled pollution control valve in zone 14A of FIG. 7.

A rigid straight valve piston shaft 132 has a head 133 that (when in closed position) fits tightly to pollution control valve seat 134. A helical spring 135 is wound around shaft 132 and is located in chamber 138 and one of its ends bears against a shoulder 136 on head 133 and another bears on the rigid valve body 137 and urges the head 133 into sealing contact with seat 134 in absence of any relative vacuum in chamber 131. When the engine 30 is running and a sufficient vacuum develops in throat 77, the valve head 133 is moved (leftward as shown in FIG. 14) away from seat 134 and gaseous suspensions pass from the crankcase 23 through crankcase outlet 92 through valve chamber 138 via gas conduit 90 through coil 81 to carburetor 71 and manifold 47. When there is no vacuum applied to chamber 131, as when engine 30 is not running, head 133 is held in seat 134 by spring 135 and blocks passage of gas from crankcase 23 to carburetor throat 77.

In the particular embodiment of engine 30 for car 140, chamber 131 is 1⅜ inch diameter with height of 1 inch and shaft 132 is ¼ inch diameter and has a travel of about ⅛ inch.

An I-head engine is diagrammatically shown in FIGS. 8-11 but the above described operation is the same for other types of engines as L-head, T-head, F-head and the like and rotary engines. The heating at the coils 85 and 87 is limited to avoid cutting down the weight of fuel charge.

The effect of the use of apparatus 30 incorporating coils 80 and 81 as above described, is shown by changes in operation of the aforementioned car 140 set out in Table I (Insert I).

Also, on running the car 140 and its engine 30 for a 822 mile trip, mostly at 60–70 miles per hours and using Gulftane gasoline through mountains, the engine ran cool and did not overheat and the exhaust was clear of any black smoke and provided an improvement of over 40% in gasoline mileage over the mileage usually obtained on the same car without the use of coils 80 and 81 as above described.

Metallic zinc nuggets 144 are placed in the tube 114 of coil 81 and fill it; these nuggets are too large to pass into and block passage of gasoline in tube 90 and provide turbulence in mixture 143 flowing through tube 114 and provides even exposure of all portions of the gaseous suspension 143 passing through tube 114 while the increase in volume of tube 114 over the ¼ in. o.d. tubing 90 provides for long exposure time of the mixture to the electromagnetic force developed by coil 81. After the 822 mile trip above referred to the zinc nuggets were not detectably smaller than when originally added to tube 114, hence are not consumed by any chemical reaction with the gases.

The action of coil 81 on the fuel 40 is demonstrated by the action of a strong bar magnet (as No. 70570 of Edmund's Catalogue No. 741; Edmund Scientific Co., Barrington, N.J., 1973) on a ½ inch long length of 1/16 inch diameter toothpick made of wood or a twisted ¾ inch long tissue paper (to a ⅛ inch diameter) mass impregnated with gasoline and floated on water in a plastic dish: the thus-impregnated toothpick and paper follow movement of the magnet while the toothpick and tissue paper without such impregnation do not follow the magnet.

Table I: Effect of Use of Apparatus 30

The apparatus of the invention thus comprises an internal combustion engine comprising, in operative combination, a. a readily magnetizable metal engine block as 22 with combustion chambers therein as 26 and 27 and a movable shaft as 28 and a shaft driving combustion driven element as 24 and 25 movably located in said combustion chambers, and b. a fuel atomizing carburetor as 71 attached to said block 22 and a fuel supply line 45 operatively connected to said carburetor, with c. a strong magnetic force producing means as 80 with its magnetic axis parallel to the length of said fuel supply line, said fuel line located within the outline of said magnetic force producing means, and d. a crankcase and e. a gas conduit as 90 extending from the crankcase of said engine to said carburetor, and f. a second magnetic field producing means as 81 with its magnetic axis extending parallel to the length of said gas conduit, said conduit located within the outline of said second magnetic force producing means.

I claim:

1. In an internal cumbustion engine comprising, in operative combination, a. a readily magnetizable metal engine block with a combustion chamber therein and a movable shaft driving combustion driven element movably located in said combustion chamber, and b. a fuel atomizing carburetor operatively attached to said block and in operative connection to said combustion chamber, a fuel supply line operatively connected to said carburetor, and a substantially constant magnetic field in the solid portion in said block adjacent said combustion chamber, the improvement which comprises, c. a heating coil and a strong unidirectional, steady, continuous magnetic force producing means with its magnetic axis parallel to a portion of the length of said fuel supply line, said portion of said fuel supply line located within the outline of said magnetic force producing means and within said heating coil; said portion of the length of said supply line being a ferromagnetic tube, said magnetic force producing means having a magnetic field, said magnetic field supplementing the magnetic field in said block.

2. Apparatus as in claim 1 wherein said engine comprises also, d. a crankcase operatively attached to said block and including a crankcase chamber adjacent to said combustion chamber and also, e. a gas conduit extending from the crankcase chamber of said engine to said carburetor, and f. a second heating coil and a strong unidirectional, steady, continuous magnetic field producing means with its magnetic axis extending parallel to a portion of the length of said gas conduit, said portion of said gas conduit located within the outline of said second magnetic force producing means and within said second heating coil, said portion of the length of said gas conduit being a ferromagnetic tube and said second magnetic force producing means having a second magnetic field, said second magnetic field supplementing the magnetic field in said block.

3. Apparatus as in claim 2 also comprising, g. an electrical ignition system comprising an electric battery and an ignition coil operatively connected thereto, said ignition coil including a primary coil and a secondary coil; said ignition coil located adjacent said engine block, and wherein, h. said first magnetic force producing means comprises an electrical coil operatively connected to said electric battery and, i. said second magnetic force producing means comprises an electrical coil operatively connected to said electric battery.

4. Apparatus as in claim 3 wherein the ferromagnetic conduit for the fuel line is located within an electrical conductor formed into a number of helical turns for heating and an equal additional number of like wound helical turns for magnetization, and the second ferromagnetic conduit, located in said gas conduit line, is located within an electrical conductor formed into a number of second helical turns for heating and a number of like wound second helical turns for magnetization, said conductor forming the second helical turns being of length twice the length of conductor forming the second helical turns for heating.

5. Apparatus as in claim 4 comprising j. two separate fuel containers, one of said containers connected by a conduit including a first fuel line valve to said fuel line, and k. another of said fuel containers connected by a second conduit including a second fuel line valve to said fuel line;

l. means for actuating each of said fuel line valves operatively connected thereto.

6. In an internal combustion engine comprising, in operative combination, a. a readily magnetizable metal engine block with a combustion chamber therein and a movable shaft driving combustion driven element movably located in said combustion chamber, and b. a fuel atomizing carburetor operatively attached to said block and in operative connection to said combustion chamber, a fuel supply line operatively connected to said carburetor, and a substantially constant magnetic field in the solid portion of said block adjacent said combustion chamber, c. a crankcase operatively attached to said block and including a crankcase chamber adjacent to said combustion chamber and also, d. a gas conduit extending from the crankcase chamber of said engine to said carburetor, the improvement which comprises, e. a heating coil and a strong, unidirectional, steady, continuous magnetic field producing means with its magnetic axis extending parallel to a portion of the length of said gas conduit, said portion of said gas conduit located within the outline of said magnetic force producing means and within said heating coil, said portion of the length of said gas conduit being a ferromagnetic tube and said magnetic force producing means having a magnetic field, said magnetic field supplementing the magnetic field in said block.

7. Apparatus as in claim 6 including solid bodies in said ferromagnetic gas conduit with passages between said bodies and passages between said bodies and said ferromagnetic tube.

8. Process of charging an internal combustion engine comprising steps of a. establishing a magnetic field in the engine block of said engine and, b. continually magnetizing the walls of a combustion chamber in said block and, c. continually passing vaporizable liquid hydrocarbon fuel from a container therefor in contact with and through a ferromagnetic conduit to an atomizing means therefor while applying a steady, unidirectional, strong magnetic force to said conduit that supplements said magnetic field in said block and heating said fuel while in said conduit and applying a magnetic field to said fuel incidental to said heating and the said step of applying a magnetic field to said ferromagnetic conduit and magnetizing the interior surface thereof being separate from the magnetic field applied to said fuel incidental to said heating step, said magnetic field applied to said ferromagnetic conduit being supplementary to said magnetic field in said block and supplementary to said field applied to said fuel in said heating step, and d. repeatedly charging said atomized fuel from said conduit into said combustion chamber within said walls.

9. Process as in claim 8 wherein said engine has a crankcase including steps of c. drawing gaseous suspension containing particulate hydrocarbon from the crankcase of said internal combustion engine in turbulent flow through a ferromagnetic conduit while applying a steady, unidirectional magnetizing force to said conduit, and d. admixing said treated suspension with said atomized liquid fuel, and e. passing the resulting admixture thereof to said combustion chamber.

10. Process as in claim 9 comprising steps of:

heating said gaseous suspension while in said ferromagnetic conduit and applying a magnetic field to said gaseous suspension incidental to said heating and, applying a magnetic field to said ferromagnetic conduit and magnetizing the interior surface thereof separate from the magnetic field applied to said suspension by said heating step, and, said magnetic field applied to said ferromagnetic conduit being supplementary to said magnetic field in said block and, also, supplementary to said field applied to said suspension in said heating step, and creating a turbulent flow of said gas suspension to contact portions thereof with the interior surface of said ferromagnetic conduit in contact with said suspension.

11. Process as in claim 10 wherein said first magnetic force producing step and first heating step applied to said ferromagnetic conduit for fuel consumes 25 watts and said second magnetic force producing step and second heating step applied to said ferromagnetic conduit through which said gaseous suspension is drawn consumes 36 watts and said first magnetizing force producing step and heating step comprises applying an electrical voltage across and an electrical current through a helical coil surrounding said ferromagnetic tube portion of said fuel line through a number of helical turns for heating thereof and an equal electrical current is applied to an additional equal number of like wound helical turns for production of said magnetic field applied to said same ferromagnetic conduit for fuel separate from the magnetic field applied thereto for heating thereof, and the second magnetomotive force producing step and heating step is effected by applying voltage across and passing an electrical current through a first series of helical turns surrounding said ferromagnetic conduit through which said gaseous suspension is drawn for heating thereof and an equal electrical current is passed through an additional number of like wound second helical turns for production of said magnetic field applied to said ferromagnetic conduit through which said gaseous suspension is drawn, and the length of the conductor forming the second helical turns is twice the length of the conductor forming said first series of helical turns for heating.

12. Process of charging an internal combustion engine having a crankcase comprising steps of a. establishing a magnetic field in the engine block of said engine and, b. continually magnetizing the walls of a combustion chamber in said block and, c. drawing gaseous suspension containing particulate hydrocarbon from the crankcase of said internal combustion engine in turbulent flow through a ferromagnetic conduit and applying a steady, unidirectional magnetizing force to said conduit, d. admixing said treated suspension with atomized liquid fuel, and e. passing the resulting admixture thereof to said combustion chamber.

13. Process as in claim 12 comprising added steps of:

heating said gaseous suspension while in said ferromagnetic conduit and applying a magnetic field to said gaseous suspension incidental to said heating and, applying a magnetic field to said ferromagnetic conduit and magnetizing the interior surface thereof separate from the magnetic field applied to said suspension by said heating step, and, said magnetic field applied to said ferromagnetic conduit being supplementary to said magnetic field in said block and, also, supplementary to said field applied to said suspension in said heating step, and creating a turbulent flow of said gas suspension to contact portions thereof with the interior surface of said ferromagnetic conduit.

14. Process as in claim 10 including step of:

f. warming the walls of said combustion chamber by passing gasoline from a first fuel container through said atomizing means and combusting said gasoline in said combustion chamber and thereafter, when said engine reaches a predetermined temperature, g. passing diesel fueld from a second container through said ferromagnetic conduit portion of said fuel line to said atomizing means while applying said steady, unidirectional magnetizing force to said conduit portion.

* * * * *